US007673646B1

(12) United States Patent
Cantolino

(10) Patent No.: US 7,673,646 B1
(45) Date of Patent: Mar. 9, 2010

(54) PAN WITH INTEGRATED EGG-SHAPED SUPPORTS

(76) Inventor: Christopher Ralph Cantolino, 2614 Manatee Ave. West, Bradenton, FL (US) 34205

( * ) Notice: Subject to any disclaimer, the term of this patent is extended or adjusted under 35 U.S.C. 154(b) by 398 days.

(21) Appl. No.: 11/973,865

(22) Filed: Oct. 10, 2007

(51) Int. Cl.
*B65D 1/36* (2006.01)

(52) U.S. Cl. ..... 137/15.01; 137/312; 220/571; 62/291

(58) Field of Classification Search ..... 137/312, 137/1, 15.01, 15.11; 220/571, 560.03; 62/291
See application file for complete search history.

(56) References Cited

U.S. PATENT DOCUMENTS 7,637,387 B1 * 12/2009 Cantolino ..... 220/571
2008/0142525 A1 * 6/2008 Brouillette ..... 220/571

* cited by examiner

*Primary Examiner*—Kevin L Lee
(74) *Attorney, Agent, or Firm*—Dorothy S. Morse

(57) ABSTRACT

A fluid-collection pan configured for supporting a unit or system responsible for fluid damage risk to its surroundings. Multiple large egg-shaped supports upwardly extend from the pan's bottom surface and are integrated with it. They also each have an arcuate top surface that is transformed into an elliptical base as it meets the pan's bottom surface. Each support also has an upwardly-tapering protrusion with a convexly-shaped top edge that extends centrally from one of the longer sides of the elliptical base toward the support's top surface. The protrusion and the narrow sides of the elliptical base form a substantially triangular shape, which broadens the weight distribution of the supported fluid-causing unit across the pan's bottom surface. The top surface of each support also has a central indentation configured for receipt of a vibration isolator that provides contact with the supported unit. Optional stress-transmitting ribs may extend between adjacent egg-shaped supports.

21 Claims, 3 Drawing Sheets

PAN WITH INTEGRATED EGG-SHAPED SUPPORTS

CROSS-REFERENCES TO RELATED APPLICATIONS

None.

BACKGROUND

1. Field of the Invention

This invention relates to pans configured for the collection of condensate and other fluids while positioned under a heavy furnace, air conditioning unit, or other fluid-causing unit presenting a risk of fluid damage to its surroundings, specifically to a fluid-collecting tray or pan (to simplify the following description only the term "pan" will be used hereinafter, since for purposes of this disclosure the terms "pan" and "tray" are considered interchangeable) of sturdy construction that is configured and used in fluid collection and overflow prevention applications for long term and stable support of a heavy unit or system posing a risk of fluid damage to its surroundings. Its main strength-enhancing features are large upwardly-extending egg-shaped supports integrated into the pan's interior bottom surface, which extend substantially across the length and width of the pan for broad distribution of a supported unit's weight throughout much of the pan. Since the egg-shaped supports are upwardly-tapering and hollow, they facilitate compact nesting of multiple pans in stacked array. Other strength-enhancing features that may be optionally included with the egg-shaped supports as a part of the present invention pan in any combination, include an upwardly-tapering protrusion associated with each egg-shaped support that in combination with the elliptical base thereof forms a substantially triangular configuration (although the perimeter edges of the triangular configuration remain arcuate) to broaden weight distribution of the supported unit further across the pan's bottom surface and help prevent collapse of the hollow egg-shaped supports under heavy load; an arcuate annular ridge extending around the base of each egg-shaped support and its associated protrusion that also broadens weight distribution of the supported unit further across the pan's bottom surface; stress-transmitting ribs extending between at least some of the annular ridges; gussets associated with the perimeter wall that have staggered interior-projecting front edges configured to minimize the formation of stress lines in the pan during pre-installation handling and after a heavy fluid-causing unit is placed upon it, a horizontally-extending rib integrated into the perimeter wall between adjacent gussets; angled corners at the base of the perimeter wall configured to reduce stress points; an upturned perimeter lip associated with the top edge of the perimeter wall that enhances strength and also increases fluid collection capacity for overflow prevention applications; a quick-mounting shelf associated with the perimeter wall that is configured for prompt and easy float switch installation; and an arcuate ribbed area configured to protect a float switch associated with the pan from side impact directed toward the pan's perimeter wall. Stable support of a fluid-causing unit that poses a fluid damage risk to its surroundings is also facilitated in the present invention by an indentation in the top surface of each egg-shaped support that is configured to receive at least one vibration isolator, which collectively provide safety-enhancing contact between the egg-shaped supports and the bottom surface of the supported unit for weight distribution management that reduces the opportunity for the supported unit to move relative to the pan after installation, and thereby lessens the likelihood of unit vibration shifting it during routine operation from its original position and causing premature pan failure or collapse. Multiple vibration isolators in a vertically stacked array may be used to adjust the supported unit to an optimum working height, and when they are made from (or adapted with) non-combustible materials, vibration isolators can be used to meet non-combustible clearance requirements in furnace applications. Vibration isolators also provide the additional advantage of enhanced heat deflection around a supported unit.

The primary use contemplated for the present invention pan is the combination of support for a heavy furnace or other unit capable of fluid discharge, fluid leaks, or condensation build-up at an installation site, and fluid overflow prevention at that site, wherein if the usual pathway for fluid discharge becomes blocked and causes fluid to accumulate in the pan, and thereafter rise above a pre-determined level considered safe, a float switch associated with the pan's perimeter wall will deploy and promptly send a shut-off signal to the supported unit to stop its operation, thereby preventing damage to the unit and/or its surroundings. An equally important use of the present invention pan is management of the routine cycles of fluid accumulation and evaporation expected in the pan during its support of a system or unit that at least periodically produces condensate as a by-product of its operation, perhaps as a result of inadequate insulation, so that collected fluid is not subject to localized pooling that could lead to sagging or buckling of the pan and perhaps result in its premature failure, or if a float switch is associated with the pan, and further so that collected fluid does not accumulate for extended lengths of time around the float switch to cause its malfunction or premature shut-off of the supported fluid-causing unit. Primary objectives and advantages of the egg-shaped strengthening structure disclosed herein are the providing of fluid collection and drain pans that facilitate pan installation to make it simpler and easier than that required for most prior art pans used in similar fluid collecting application, minimize the need for post-installation inspection and maintenance of the pans and any shut-off switches mounted on their perimeter walls, shorten the installation time of pans and shut-off switches, provide stable and reliable pan and shut-off switch installations, reduce the number of cracks and weak spots created as a result of pan handling prior to and during its installation, and reduce the likelihood of pan collapse due to unbalanced weight distribution when fluid accumulates in the pan during routine use.

2. Description of the Related Art

When air conditioning condensate and other condensates are collected, there is often a risk of overflow or back-up into the system producing it. As a result, a fluid collection and/or drain pan is typically placed under the condensate-producing unit with a liquid-level float switch mounted on the pan that sends a shut-off signal to the source of condensate flow to stop its operation when the amount of fluid collected exceeds a predetermined depth considered safe. If installed in an attic, on hot summer days a fluid collection pan under a condensate-producing unit can be subjected to temperatures exceeding 140-degrees Fahrenheit, which has led to perimeter wall lean-in and float switch malfunction in many prior art pans. In the alternative, an installation site can expose a fluid collection pan to significant temperature fluctuations or be a tight space that requires the installer to bend, twist, and/or step on the pan at least once before installation is complete. If the pan's materials and design are thin and/or weak in any way, cracks and weak spots can result that increase the likelihood of premature pan failure, or total pan collapse. Pans installed for support of furnaces and other units responsible for fluid damage risk to their surroundings are also subject to temperature and space limitation issues, and in addition furnace installations typically require a designated amount of non-combustible clearance. Through its use of selected materials that are chosen for their strength and temperature resistance as well as high impact resistance and corrosion resistance, a structured design chosen for its strength-enhancing properties, and a design selected because it helps to evenly pull plastic during pan manufacture so that thin and weak areas are avoided that would otherwise create pressure points when the finished material is inadvertently bent or twisted, the present invention is able to provide a pan for collection of condensates and other fluids resulting from the operation of a fluid-causing unit placed upon its egg-shaped supports that is superior to prior art pans in multiple ways, including being more rugged than most other prior art fluid collection pans, having a sturdy construction that facilitates pan installation, reduces installation time, provides stable pan and float switch installation, reduces the number of cracks and weak spots, created by pre-installation handling of the pan, reduces the possibility of pan collapse due to unbalanced weight distribution when fluid accumulates in the pan, minimizes post-installation inspection and maintenance of pan and the shut-off switch mounted on its perimeter wall, and when a quick-mounting shelf is a part of the present invention pan's perimeter wall structure, float switch mounting on the pan's perimeter wall has the advantage of being prompt and requiring no guesswork relating to placement of the shut-off switch in a level orientation since the easy step of leveling the pan simultaneously places the float switch into a level orientation for immediate, reliable, repeat, and reproducible deployment of a fluid-level-activated float body whenever fluid accumulating in the pan exceeds the pre-established (or custom-set) threshold amount considered safe to prevent damage to surroundings. Another advantage of present invention pan structure over that of some prior art pans is that present invention pan structure allows for even flow of collected fluid throughout its bottom surface, preventing the localized pooling of fluid in any one area including the area around the float switch. By preventing the float switch associated with it from remaining in contact with accumulated fluid, there is a reduced likelihood for it to become clogged with mold, algae, and/or debris, which could otherwise cause it to malfunction. Another problem overcome by the present invention pan is the likelihood of pan failure resulting from cracking, bowing, distortion, bending, warping, buckling, and/or collapse due to fluid distribution imbalance, particularly when it is supported upon blocks, trusses, or other discontinuous surface. This is accomplished in the present invention pan through its integrated structural features that avoid extended stress lines, including the curved surfaces of the annular ridges and egg-shaped supports, the curved surfaces of the vertically-extending protrusions associated with the egg-shaped supports, the staggered interior-projecting edges of the gussets, the use of angled corners, the placement of stress-transmitting ribs between some of the egg-shaped supports in close proximity to one another, and the use of vibration isolators in top indentations of the egg-shaped supports which retain the heavy fluid-causing unit resting upon them substantially in its original position during routine use. Further, the non-combustible clearance required in furnace applications can be met through use of one or more vibration isolators, in stacked array if needed, upon the tops of the egg-shaped supports, which can be made from non-combustible material or otherwise covered or adapted to meet the non-combustible clearance requirement. No other fluid collection or drain pan is known that functions in the same manner as the present invention, has the egg-shaped structure disclosed herein, or provides all of the advantages of the present invention.

BRIEF SUMMARY OF THE INVENTION

It is the primary object of this invention to provide a tray or pan of rugged construction with an integrated support system that is designed and configured to enhance material strength so that it will resist cracking and premature failure during pre-installation handling, and also prevent premature pan failure or collapse during its use in fluid collection and overflow prevention applications after installation. It is also an object of this invention to provide a fluid-collecting pan or tray of sturdy construction for use in stable, long duration, and pre-leveled support of a liquid-level-activated float switch that is configured to shut-off fluid production of a unit supported by the pan when fluid accumulation in the pan exceeds a pre-established threshold amount considered safe to prevent damage to surroundings, so that needed deployment of the switch's float body remains reliable and repeatable during the full time period of its use. A further object of this invention is to provide a pan configured for balanced distribution of collected fluid therein that prevents fluid from pooling in one location, whereby the likelihood of pan distortion is reduced, shifts in supported unit position during routine use that would otherwise interfere with reliable float body deployment are minimized, and/or the likelihood of pan collapse is also reduced. It is a further object of this invention to provide a pan made from materials that are strong, impact resistant, heat resistant, non-flammable, impervious to corrosion, unaffected by extreme ambient temperature fluctuations, and resistant to buckling, bowing, warping, distortion, and collapse during extended use. It is also an object of this invention to provide a pan that enhances reliable float switch operation by protecting its associated float body during long term use against side impact directed toward the perimeter wall as well as clogging with mold, algae, and/or debris, including the loose insulation fibers typically encountered in attics with some air conditioning unit installations. In addition, it is also an object of this invention to provide a fluid collection pan that facilitates installation, enables stable installation, shortens installation time, and requires minimal post-installation inspection and maintenance of the pan and its associated float switch. A further object of this invention is to provide a fluid collection pan with a nesting structure for efficient transport and storage of multiple pans in stacked array. It is also an object of this invention to provide a pan that incorporates means adapted to prevent unexpected shifting of the supported fluid-causing unit relative to the pan during routine use and also meet non-combustible furnace clearance requirements in furnace applications.

The present invention, when properly made and used, provides a fluid-collection pan of sturdy construction that is configured and used in fluid collection and overflow prevention applications for long term support of a heavy unit or system posing a fluid damage risk to its surroundings. It has an integrated support system structured to provide enhanced material strength, with pan strength derived from its multiple raised egg-shaped supports that extend substantially across the length and width of the pan's bottom surface and pull plastic evenly during pan manufacture to avoid thin and weak areas. Pan strength is further derived from the elliptical base of each egg-shaped support that in combination with an upwardly-tapering protrusion creates a substantially triangular shape which broadens the weight distribution of the supported fluid-causing unit across more of the pan's bottom surface, an optional annular ridge around the elliptical base of each egg-shaped support and its associated protrusion, and optional stress-transmitting ribs extending between adjacent egg-shaped supports with positioning that does not impede fluid flow throughout the non-raised areas of the pan's interior bottom surface between the perimeter wall and the egg-shaped support. Further, non-raised areas in the pan are substantially level with one another so that collected fluid does not pool in a single area of the pan and potentially lead to bowing and/or buckling of that area, as well as perimeter wall lean-in and/or twisting of the pan. Thus also, excess fluid is not directed to the float switch to cause premature shut-off of the supported fluid-causing unit or pooling of fluid around the switch's float body that could transport debris to the float body, and/or promote algae growth on it, both of which could seriously interfere with proper, reliable, and repeat float body deployment when needed for emergency shut off of the associated unit to prevent fluid damage to surroundings. Another advantage of the present invention structural design that evenly pulls plastic during its manufacture, is that when uniform material thickness is achieved in a pan, a fluid-causing unit can be supported with less material thickness and manufacturing costs are reduced. In addition to enhanced material strength, the reduced incidence of pan material cracking during pre-installation handling and use to support a fluid-causing unit provided by the egg-shaped supports reduces the need for post-installation inspection and maintenance of the pan and any associated float switch. Further benefits of the egg-shaped structural design are enhanced safety and extended duration of present invention pan use over most prior art pans used in the same or similar applications.

The egg-shaped supports each have a circular top surface that is transformed into an elliptical base as it meets the pan's bottom surface, and the upwardly-tapering protrusion typically associated with each egg-shaped support has a convexly-curved top edge that extends centrally from one of the longer sides of the elliptical base toward the support's top surface. The top surface of each egg-shaped support also has a central indentation configured for receipt of at least one vibration isolator, which collectively provide safety-enhancing contact between the egg-shaped support and the bottom surface of the supported fluid-causing unit for weight distribution management that reduces the opportunity for movement of supported unit relative to the pan and thereby lessens the likelihood of premature pan collapse. Multiple vibration isolators in a vertically stacked array may be used to adjust the supported unit to an optimum working height, and when made from (or adapted with) non-combustible materials, vibration isolators can be used to meet non-combustible clearance requirements in furnace applications. Vibration isolators also provide reduced vibration and enhanced heat deflection around a supported fluid-causing unit. Egg-shaped supports are located substantially across the length and width of the pan's bottom surface. The egg-shaped supports are also large and sturdy, have a hollow upwardly-tapering interior that facilitates nesting of multiple stacked pans, have a top surface extending upwardly above the top of the perimeter wall, all have substantially the same height dimension, and they may be aligned into two longitudinally-extending rows that are off-set (non-centered) in positioning relative to the pan's bottom surface so as to locate the supports under the heaviest portions of a fluid-containing unit that is not evenly balanced in weight. The off-set positioning can also leave more room for easier installations, and space for positioning drain lines and gas lines. An annular ridge around the egg-shaped supports and their upwardly-tapering protrusions helps to distribute the weight of the supported unit over a wider portion of the pan's bottom surface, and the convexly-curved perimeter configuration of the annular ridge reduces the number of pressure points in the pan that could lead to cracking and premature failure. When stress-transmitting ribs are present between adjacent egg-shaped supports, the annular ridge around each egg-shaped support merges with near end of the rib extending toward it. Any angular-to-arcuate (or arcuate-to-angular) transition present between the ribs and the annular ridges is softened to reduce pressure points.

It is the structured design of the present invention pan, in addition to the polycarbonate material from which it is substantially made, that together allow it to resist cracking during installation, as well as bowing, bending, warping, buckling, distortion, and collapse during extending time periods of use. Preferred materials include but are not limited to polycarbonate, polycarbonate alloys, polycarbonate blends, polycarbonate alloys and blends using ABS, polycarbonate alloys and blends using PBT, polycarbonate alloys and blends using PET, polycarbonate alloys and blends using PP, materials impervious to corrosion, impact resistant materials, heat resistant materials, non-flammable materials, and materials substantially unaffected by large ambient temperature fluctuations. Resistance to UV radiation is not necessarily a contemplated feature of the present invention, unless dictated by the application. Strengthening features may also be provided in the perimeter wall structure of the present invention pan, and may include any of the following, alone or in combination, staggered perimeter gussets, at least one horizontally-extending perimeter rib between gussets, angled corners, an up-turned perimeter lip, a mounting shelf configured for quick attachment of a shut-off switch, and a ribbed area configured for protecting the a float switch from side impact directed toward the perimeter wall. Their configurations also help to reduce the number of pressure points in the pan that could lead to its premature cracking and/or failure. When a quick-mounting shelf is used in the present invention pan for attaching a float switch in fixed association with a drain line connection having a configuration complementary to the mounting shelf, rapid float switch installation is achieved and automatic leveling of the float body occurs when the pan is placed into a level orientation. Only a simple height adjustment of the deployable float switch body may additionally be required during installation, according to the quantities of fluid collection anticipated in an application and the depth of fluid considered safe in the particular application. Although the use of a quick-mounting shelf is not critical to the present invention pan, it is preferred for the many advantages it provides during float switch installation and use. An equally important use of the present invention pan is management of the routine cycles of fluid accumulation and evaporation expected to occur in it during the support of a fluid-causing system or unit that at least periodically produces condensate as a by-product of its operation, perhaps as a result of inadequate insulation, so that pooling of collected fluid in a single area of the pan is prevented to avoid bowing and/or buckling in that area and the potential for buckling and pan collapse.

The description herein provides preferred embodiments of the present invention but should not be construed as limiting its scope. For example, variations in the number, height dimension, and configuration of vibration isolators or other dampening inserts used in association with the egg-shaped supports' indentations; the material from which vibration isolators are made and whether they would be readily replaceable or fixed within the top indentation of an egg-shaped support; the number, width dimension, depth dimension and configuration of the perimeter wall gussets used; whether all of the perimeter wall gussets would have a uniform width dimension or a horizontally-extending rib depending between adjacent gussets; the number of egg-shaped supports used; the height of the egg-shaped supports above the top of the perimeter wall; whether the egg-shaped supports are in rows that are centered or non-centered relative to the pan's bottom surface; and the presence of the quick-mounting shelf used for prompt connection of a drain line and float switch assembly, other than those shown and described herein, may be incorporated into the present invention. Thus the scope of the present invention should be determined by the appended claims and their legal equivalents, rather than being limited to the examples given.

DETAILED DESCRIPTION OF PREFERRED EMBODIMENTS

Figure 1:
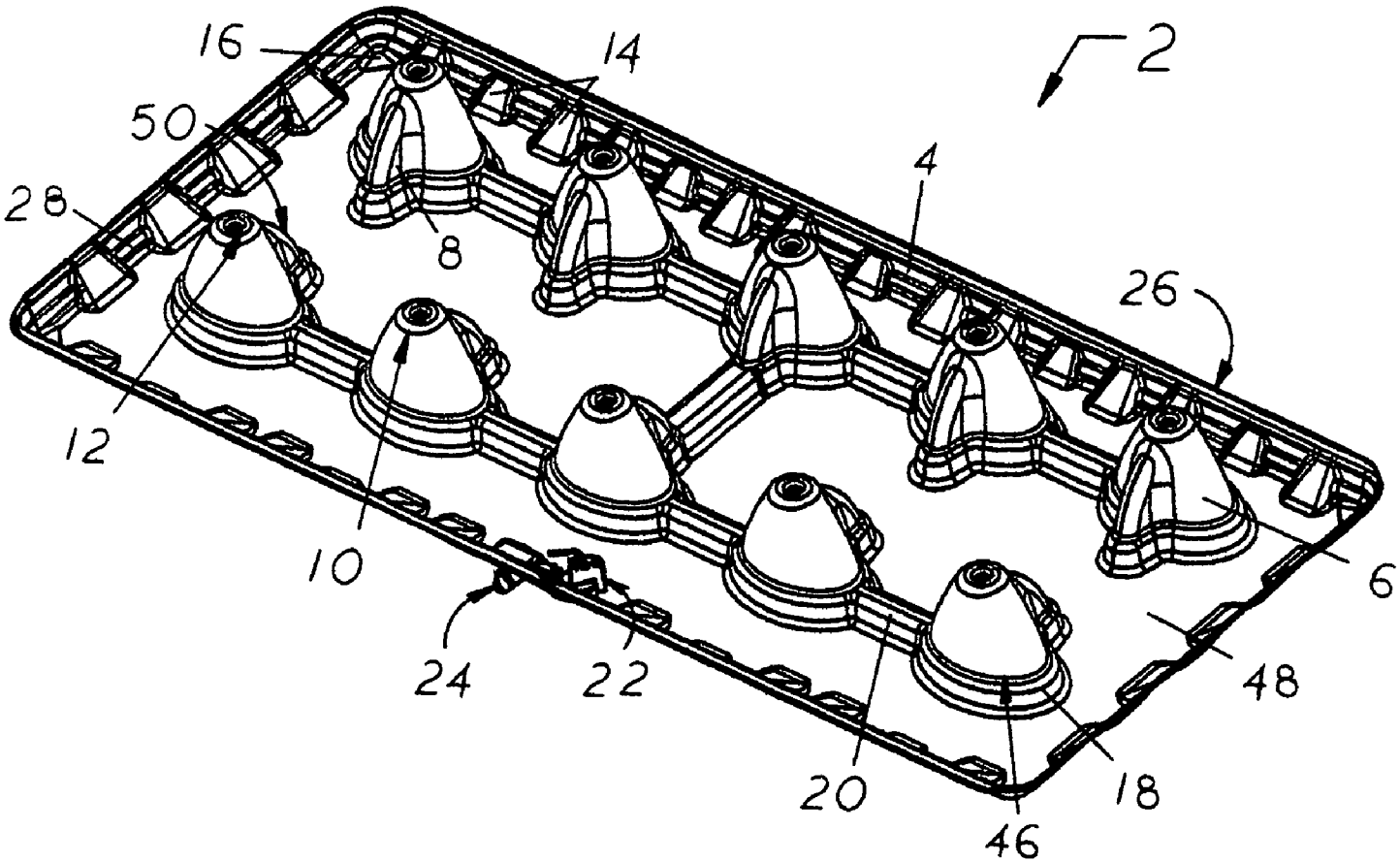
FIG. 1 is a perspective view of the most preferred embodiment of the present invention pan having multiple egg-shaped supports spaced apart from one another substantially across the pan's length and width, each egg-shaped support having a top indentation and an elliptical base, each egg-shaped support also having an upwardly-tapering protrusion with an arcuate top edge depending therefrom so that in combination with the elliptical base a strength-enhancing substantially triangular configuration is formed, with the pan also having an arcuate annular ridge around the base of each egg-shaped support and associated protrusion, and stress-transmitting ribs connected between the annular ridges of some egg-shaped supports that are in close proximity with one another, with the perimeter wall also shown to have gussets with staggered interior-projecting edges, a horizontally-extending rib between gussets, angled corners, an upturned top lip, and a quick-mounting shelf that supports a float switch and drain connection assembly.
Figure 2:
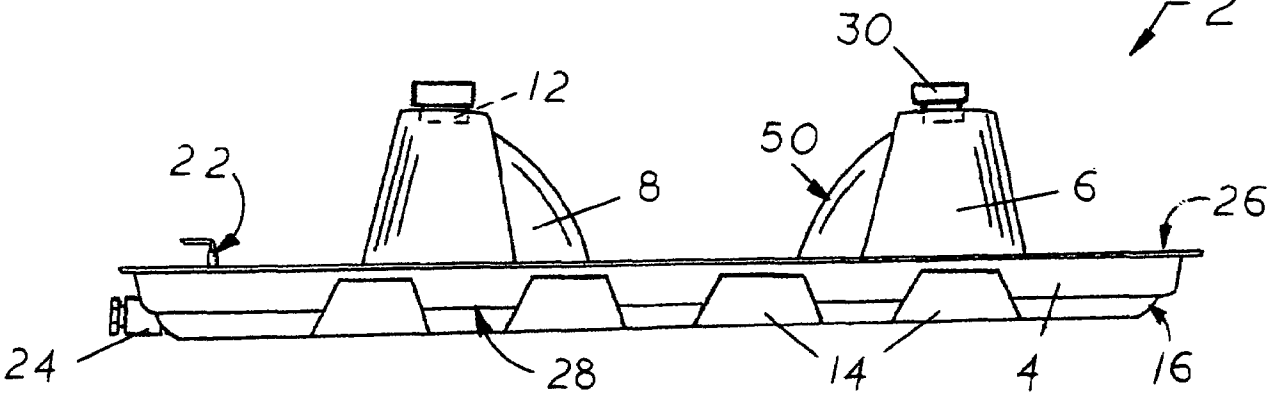
FIG. 2 is an end view of the most preferred embodiment of the present invention pan with two egg-shaped supports shown extending substantially above the top of the perimeter wall, an upwardly-tapering protrusion associated with each egg-shaped support, protrusions extending toward one another, a vibration isolator positioned within the top indentation of each egg-shaped support, multiple gussets integrated into the perimeter wall, a horizontally-extending rib between gussets, angled corners, and a float switch and drain line connection assembly associated with the pan's perimeter wall and attached through it.
Figure 5:
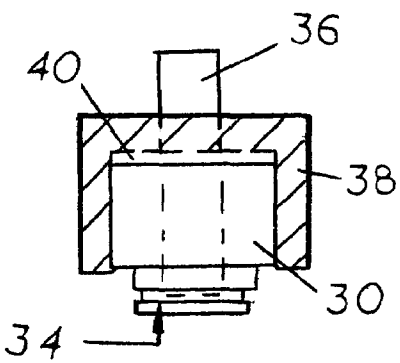
FIG. 5 is a side view of one vibration isolator shown in FIG. 3 that is further adapted to satisfy non-combustible clearance requirements in furnace applications, wherein a clearance assembly preferably made of non-combustible metal or ceramic is supported by the vibration isolator in a position to completely cover the annular shoulder of the vibration isolator.
Figure 4:
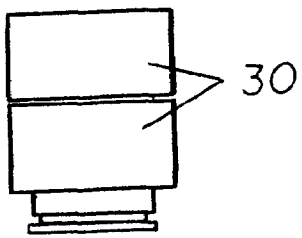
FIG. 4 is a side view of two of the vibration isolators shown in FIG. 3, with one positioned above the other in stacked array.
Figure 3:
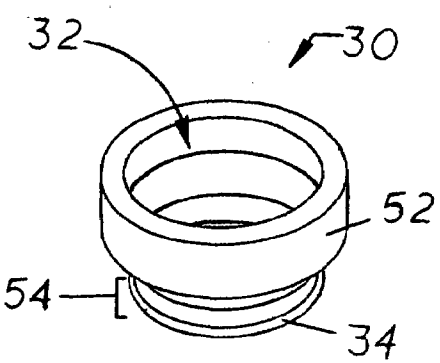
FIG. 3 is a perspective view of a preferred vibration isolator contemplated for use as a part of the present invention and having a ring-shaped configuration that includes an annular shoulder, a central bore, and a smaller diameter lower end with at least one external rib encircling it.
Figure 6:
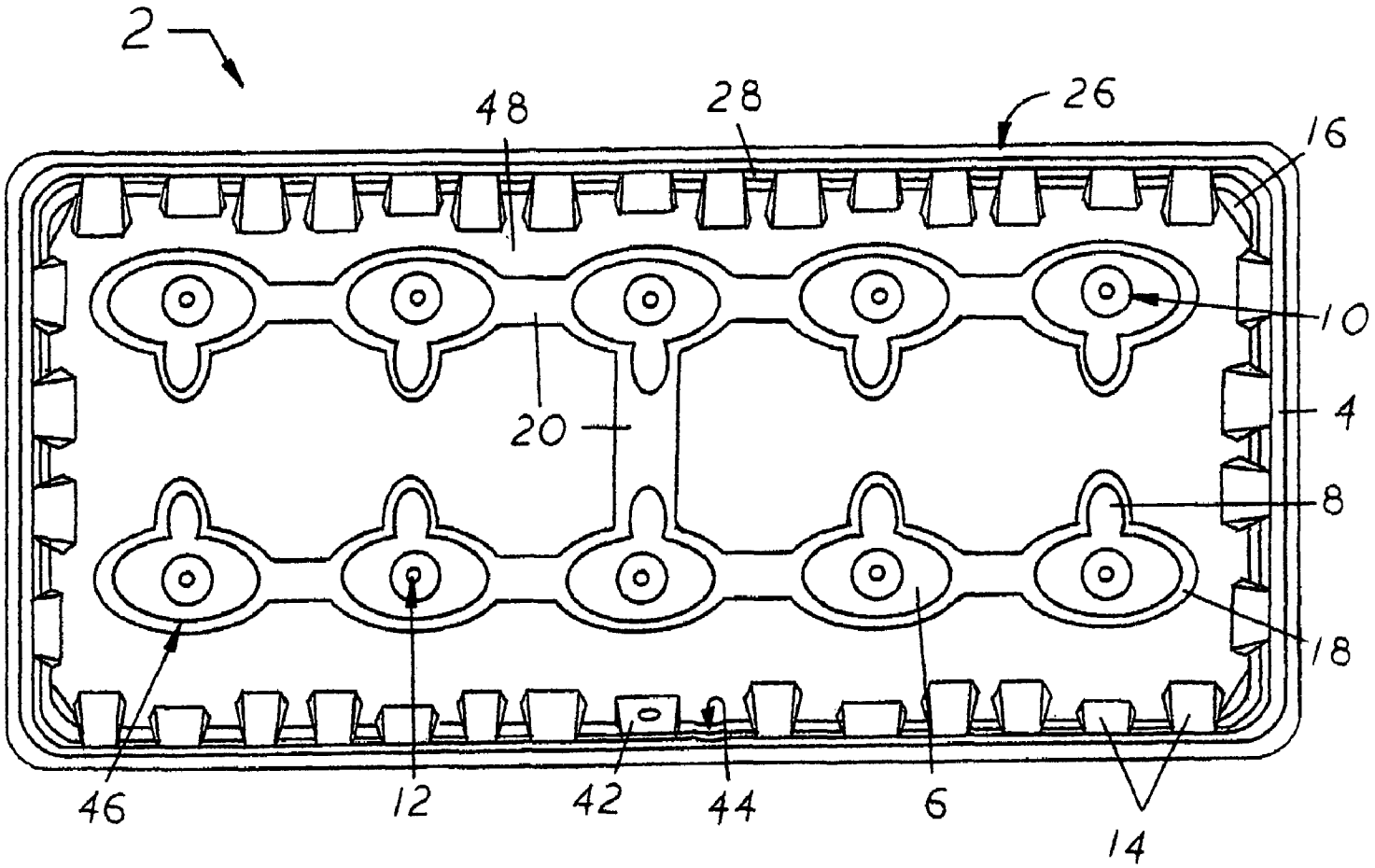
FIG. 6 is a top view of the most preferred embodiment of the present invention pan having multiple egg-shaped supports spaced apart substantially across its length and width, each egg-shaped support having a circular top surface and an elliptical base, each egg-shaped support also having an indentation in its top surface, with egg-shaped supports substantially aligned in two longitudinally-extending rows, the rows positioned off-center longitudinally relative to the perimeter wall, a protrusion depending from each support that in combination with the elliptical base creates a substantially triangular and strength-enhancing configuration, protrusions positioned so that those in different rows extend toward one another, an arcuate annular ridge extending around the base of each egg-shaped support and associated protrusion, and stress-transmitting ribs connected between the annular ridges on some of the egg-shaped supports in close proximity with one another, with the perimeter wall also shown to have gussets with staggered interior-projecting edges, a horizontally-extending rib between gussets, angled corners, an upturned top lip, a quick-mounting shelf configured to support a float switch and drain connection assembly (partially revealed in FIGS. 1 and 2), and an arcuate ribbed area that provides protection of a float switch from side impact directed toward the perimeter wall.

While FIGS. 1, 2, and 6 show the most preferred embodiment 2 of the strong and rugged present invention fluid collection pan (sometimes hereinafter also referred to as pan 2), FIGS. 3, 4, and 5 shows one example of a vibration isolator 30 that can be used in the top indentation 10 of each egg-shaped support 6 in most preferred embodiment 2 for vibration reduction, to prevent movement of a supported fluid-causing unit (not shown) from its originally installed position collectively upon multiple egg-shaped supports 6 during routine use, and for enhanced heat dissipation around the associated furnace, air-conditioning system, or other fluid-causing unit while it is being supported upon the egg-shaped supports 6. Although not shown, pan 2 is typically used (but not limited thereto) for horizontal support of a fluid-causing unit upon the ground, a floor, floor joists, or attic beams. It is to be understood that many variations in the present invention, including variations in the configurations of vibration isolators 30, are also considered to be a part of the invention disclosed herein even though such variations are not specifically mentioned or shown. As a result, a reader should determine the scope of the present invention by the appended claims and not make any limiting assumptions based upon the examples given below.

FIGS. 1, 2, and 6 show the most preferred embodiment 2 of the present invention pan having a substantially rectangular interior bottom surface 48 defined by a substantially rectangular perimeter wall 4, and ten spaced-apart egg-shaped supports 6 upwardly depending from interior bottom surface 48. The rectangular configuration of interior bottom surface 48 and perimeter wall 4 are preferred, but not critical. The size of pan 2 is also not critical. Between perimeter wall 4 and egg-shaped supports 6, interior bottom surface 48 is substantially planar to prevent pooling of collected fluid thereon in any localized area and thereby potentially causing premature pan 2 failure. FIGS. 1 and 6 also show each egg-shaped support 6 having an upwardly-tapering configuration and a circular top surface 10 that widens into an elliptical base 46. The important goals in the structural design of most preferred embodiment 2 relating to the reduction of stress points and the even pulling of plastic during manufacture to reduce thin areas prone to cracking and sagging, dictate an arcuate configuration for the top surface 10 of each egg-shaped support 6, circular or other, with the same goals also being achieved by the arcuate configuration of the elliptical base 46 of each egg-shaped support 6. The size of perimeter wall 4 (and thus interior bottom surface 48) is not fixed and may be determined by several factors, including but not limited to, the size of the fluid-causing unit (not shown) to be supported by egg-shaped supports 6 in an intended application, the space available for pan 2 at an installation site, the amount of fluid generation anticipated during routine cycles of collection and evaporation from the supported fluid-causing unit (not shown), and manufacturing cost. The relative height of perimeter wall 4 as compared with that of egg-shaped supports 6 is also not fixed, and may be different from that shown in FIGS. 1 and 2. However, it is contemplated for egg-shaped supports 6 to generally be large and always extend above perimeter wall 4 so that all structural support for a fluid-causing unit (not shown) is provided by egg-shaped supports 6. Further, although ten egg-shaped supports 6 are shown in FIGS. 1 and 6, the number used may be different from that shown. Strengthening features for pan 2 may also be provided in the structure of the perimeter wall 4, and may include any of the following, alone or in combination, perimeter gussets 14 with staggered front edges, at least one horizontally-extending perimeter rib 28 between gussets 14, angled corners 16, an up-turned perimeter lip 16, a mounting shelf 42 configured for quick attachment of a shut-off switch 22, and an arcuate ribbed area 44 configured for protecting an associated float switch 22 from side impact directed toward the perimeter wall. Their configurations also help to reduce the number of pressure points in pan 2 that could lead to its premature cracking and/or failure. When a quick-mounting shelf 42 is used in the present invention pan 2 for attaching a float switch 22 in fixed association with a drain line connection 24 having a configuration complementary to the mounting shelf 42, rapid float switch installation is achieved and automatic leveling of the float body within switch 22 occurs when the pan 2 is placed into a level orientation. Only a simple height adjustment of the deployable body of float switch 22 may additionally be required during installation, according to the quantities of fluid collection anticipated in an application and the depth of fluid considered safe in the particular application/location. Although the use of a quick-mounting shelf 42 is not critical to pan 2, it is preferred for the many advantages it provides during float switch installation and use. Since the use of mounting shelf 42 and arcuate ribbed area 44 are optional features of pan 2 and the combined float switch 22 and drain line connection 24 assembly to be used with them forms no part of the present invention structure, and further since the structure of the combined float switch 22 and drain line connection 24 assembly (also created by the inventor herein) to be used with mounting shelf 42 and arcuate ribbed area 44 is revealed in other U.S. Patent disclosures, detailed information about the structure of the combined float switch 22 and drain line connection 24 assembly has not been made a part of this invention disclosure.

FIGS. 1, 2, and 6 also show a protrusion 8 depending radially from each egg-shaped support 6 and extending upwardly from the elliptical base 46 of the associated egg-shaped support 6 almost to its circular top surface 10. Although only one protrusion 8 is shown with each egg-shaped support 6, it is considered to be within the scope of the present invention for at least one egg-shaped support to have more than one protrusion 8. In addition, FIGS. 1 and 2 show protrusions 8 having a convexly-shaped top edge 50, which contributes to the even pulling of plastic and reduction of stress points in most preferred embodiment 2 would otherwise result from the use of angular interfaces. The central orientation of protrusions 8 and their alignment with the protrusion 8 of an opposed egg-shaped support 6 in an opposed row, as shown in FIGS. 1 and 6, is not critical but preferred, as it also strengthens most preferred embodiment 2 by contributing to the even distribution of material during manufacture that reduces weak spots. Further, although not critical, a nesting configuration is desired in most preferred embodiment pans 2 so that they can be compactly storage in stacked array for efficient and cost-saving transport and storage. Although not shown in FIGS. 1, 2, and 6, stacking of most preferred embodiment 2 pans is facilitated by the hollow interior of its egg-shaped supports 6 and their open bottom surface. However, even though it is contemplated for egg-shaped supports 6 to be hollow, their strength is not compromised as the even distribution of plastic during manufacture and the upwardly-tapering of egg-shaped supports 6 prevent them from collapsing during routine support of a heavy fluid-causing unit. Other strengthening features of most preferred embodiment 2 that also help to distribute the weight of a supported fluid-causing unit across a broader portion of interior bottom surface 48 include the strength-enhancing triangular configuration formed by upwardly-tapering protrusion 8 and elliptical base 46, the optional arcuate annular ridge 18 around the elliptical base 46 of each egg-shaped support 6 and associated protrusion 8, and the optional stress-transmitting ribs 20 connected between the annular ridges 18 on some of the egg-shaped supports 6 that are in close proximity with one another. It is important that stress-transmitting ribs 20 are positioned to allow the free-flow of collected fluid throughout the non-raised areas of interior bottom surface 48 and prevent pooling of fluid in a single area that could lead to premature pan 2 failure due to sagging or buckling, malfunction of an associated float switch 22 caused by lean-in of perimeter wall 4 and/or twisting of pan 2, premature shut-off of a supported fluid-causing unit caused by pooling of fluid around an associated float switch 22, and/or malfunction of an associated float switch 22 caused by pooling of fluid around the switch's float body that contains debris and/or promote algae growth on it. For this same purpose, it is contemplated for the non-raised areas in interior bottom surface 48 between the perimeter wall 4 and the egg-shaped supports 6 to be made substantially level with one another. For even pull of plastic during manufacture, in most preferred embodiment 2 it is contemplated for all annular ridges 18 and all stress-transmitting ribs to be approximately the same height dimension above the pan's interior bottom surface 48. However, in other patentably non-distinct embodiments of the present invention, the height dimensions of the annular ridges 18 and stress-transmitting ribs used may be different. As previously mentioned, the height of egg-shaped supports 6 above perimeter wall 4 is not fixed and may be different from that shown in FIGS. 1 and 2. Thus, in furnace applications requiring a minimum non-combustible clearance, the height egg-shaped supports 6 relative to perimeter wall 4 may be greater than in a non-furnace application. However, it is contemplated for egg-shaped supports 6 to always extend above perimeter wall 4 so that all structural support for an associated fluid-causing unit (not shown) is provided via egg-shaped supports 6.

FIG. 6 is a top view of most preferred embodiment 2 showing many of the same features of most preferred embodiment 2 shown in FIG. 1, except the convexly-contoured top edges 50 of protrusions 8 and the associated float switch 22 and drain line connection 24. Instead, FIG. 6 shows most preferred embodiment 2 without an associated float switch 22 or drain line connection 24, thereby revealing the mounting shelf 42 for drain line connection 24 and the arcuate ribbed area 44 (having an array of vertically-stacked and horizontally-extending ribs) that protects an associated float switch 22 from most side impact directed toward perimeter wall 4 during pre-installation handling and use after installation. Attachment of the drain line connection 24 to mounting shelf 42 automatically places float switch 22 in level orientation relative to pan 2. Thus, when pan 2 is placed into a level orientation during its installation, the deployable float body within float switch 22 attached to pan 2 (attached either during its manufacture, pre-installation, installation) instantly becomes poised for proper, reliable, and repeat deployment to shut off the associated fluid-causing unit supported by pan 2 when excess fluid from the fluid-causing unit collects in pan 2 beyond a pre-determined threshold amount considered safe to prevent damage to surroundings. After the drain line connection 24 is aligned with quick-mounting shelf 42, the float switch 22 in fixed association with drain line connection 24 is automatically placed adjacent to the arcuate ribbed area 44. Further, all that is needed to secure drain line connection 24 to pan 2 and place float switch 22 in level orientation relative to pan 2, is the insertion of the threaded tailpiece (shown in FIG. 2 where the line associated with the numeral 24 ends) of drain line connection 24 through the opening (shown in FIG. 6 immediately to the right of the line associated with the numeral 42 ends) in mounting shelf 42 and the tightening of a nut (not shown) on the tailpiece from the outside of pan 2. Depending upon the application of pan 2, although not marked with numerical identification, a plug (shown at the end of the tailpiece in FIG. 2) where the line associated with the numeral 24 ends) may be used to block fluid discharge from the tailpiece of drain line connection 24, or the tailpiece of drain line connection 24 can be connected to a drain pipe (not shown) that is configured to transport excess fluid away from pan 2.

FIGS. 1 and 6 show multiple egg-shaped supports 6 spaced apart substantially across its length and width, each egg-shaped support having a circular top surface 10 and an elliptical base 46, and each egg-shaped support 6 also having an indentation 12 in its top surface 10 configured for securely holding a vibration isolator (such as the vibration isolator 30 in FIG. 3). Although also shown in FIG. 1, FIG. 6 more clearly shows the off-center positioning of the connected egg-shaped supports 6 and stress-transmitting ridges 20 between them that may be optionally used. This can be important when the weight of the supported fluid-causing unit (not shown) intended for positioning upon egg-shaped supports 6 is not balanced to locate egg-shaped supports 6 under the heaviest portions of the fluid-causing unit and help maintain the fluid-causing unit in its originally installed position during routine use. FIG. 6 also more clearly shows the substantially triangular configuration created by each protrusion 8 and the elliptical base 46 of its associated egg-shaped support 6 that provides strength-enhancing benefit to pan 2. In addition, FIG. 6 also provides a complete view of the arcuate annular ridge 18 extending around the arcuate outline of the elliptical base 46 of each egg-shaped support 6 and its associated protrusion 8, and further shows the softened transitions between the angular perimeters of the stress-transferring ribs 20 and the arcuate perimeters of the annular ridges 18 that are intended to reduce pressure points in most preferred embodiment 2. Also, since stress-transmitting ribs 20 are an optional feature of the present invention, the number and positioning of stress-transmitting ribs 20 between egg-shaped supports 6 is not limited to that shown in FIGS. 1 and 6. Additionally, the varying configurations of the gussets 14 integrated into perimeter wall 4 are also more clearly shown in FIG. 6, which are desired to reduce stress points and thereby add strengthening benefit to pan 2. Thus, as shown in FIGS. 1 and 6, it is contemplated for some gussets 14 to have their interior-projecting front edges in staggered array relative to that of adjacent gussets 14, adjacent gussets 14 with differing width dimensions, and varying spaced-apart distances between adjacent gussets 14.

The egg-shaped supports 6 in pan 2 are purposefully dimensioned and configured to widen the portion of the interior bottom surface 48 directly bearing the weight load of an associated fluid-causing unit (not shown) to further reduce tendencies of most preferred embodiment pan 2 toward bending, bowing, warping, cracking, and/or other distortion that have been found to occur in prior art pans during the extended time periods contemplated for use. Although the length, width, and height dimensions of perimeter wall 4 are not critical, they must be appropriate to the intended application and not so overly large relative to the associated fluid-causing unit to cause material waste or be too large for easy installation in a location with limited space. Also, the height dimensions of egg-shaped supports 6 must all be similar to one another to provide balanced support for an associated unit (not shown). Further, egg-shaped supports 6 generally are configured to substantially fill the interior bottom surface 48 to diminish the amount of fluid collected in the interior bottom surface of pan 2 prior to unit shut-off by an associated float switch, such as the switch shown by the number 22 in FIGS. 1 and 2. Egg-shaped supports 6 are also configured and positioned to promote the free flow of collected fluid across interior bottom surface 48 for balanced weight distribution of collected fluid during routine cycles of accumulation and evaporation without bowing, buckling, or other distortion of interior bottom surface 48 and/or perimeter wall 4. Further, the materials used for the present invention pan 2 are strong, impact resistant, heat resistant, impervious to corrosion, non-flammable, unaffected by large ambient temperature fluctuations, and resistant to buckling, bowing, warping, distortion, and collapse during extended use. Resistance to UV radiation is not necessarily a contemplated feature of the present invention, unless dictated by the application. Polycarbonate, polycarbonate alloys, and polycarbonate blends are preferred for pan 2, including but not limited to polycarbonate alloys and blends using ABS, PBT, PET, and PP. Manufacture of the present invention could be accomplished by blow molding, injection molding, assembly of pre-formed individual components, or a combination thereof, with the choice of manufacturing being determined by the anticipated purchase cost to consumers and the expected duration of use without maintenance, parts replacement, or repair. Thus, the structure design of the present invention that includes egg-shaped supports 6 upwardly-extending from interior bottom surface 48 provides many improvements over prior art pans used for fluid collection, including but not limited to enhanced material strength, a reduced incidence of cracking during installation and use that reduces the need for inspection and maintenance after installation, a greater duration of use, and improved safety during pan installation and use. These same benefits apply in overflow prevention applications, wherein if the usual discharge pathway for produced fluid becomes blocked and causes fluid to accumulate in the pan and thereafter rise above a pre-determined level considered safe, a float switch (such as that identified by the number 22 in FIGS. 1 and 2) associated with the pan's perimeter wall 4 will deploy and promptly shut-off the supported unit's operation to prevent damage to the unit and/or its surroundings, as well as in applications involving the management of routine cycles of fluid accumulation and evaporation expected during the support of a system or unit that at least periodically produces condensate as a by-product of its operation, perhaps as a result of inadequate insulation.

FIGS. 3-5 respectively show vibrations isolators 30 contemplated for use as a part of the present invention to enhance safe and stable support of a fluid-causing unit collectively by egg-shaped supports 6. FIG. 3 shows a preferred configuration of a vibrations isolator 30, while FIG. 2 shows stacked positioning of two vibration isolators 30 and FIG. 3 shows one possible furnace adaptation of a vibration isolator 30. In addition to their vibration reducing function, vibration isolators 30 also provide the additional advantage of enhanced heat deflection around a fluid-causing unit while it is supported by egg-shaped supports 6. FIG. 3 shows a vibration isolator 30 having ring-shaped configuration with a large diameter shoulder 52, a reduced diameter lower portion 54, a sealing rib 34, and a central bore 32. In the alternative, although not shown, lower portion 54 may have a slight downward taper, more than one sealing rib 34, or no sealing ribs 34. Using two or more ring-shaped vibration isolators 30 in stacked array, as shown in FIG. 4, is an easy way to raise an associated unit (not shown) to optimal operating height, if needed. Although the vibration isolator 30 in FIG. 3 is shown to be ring-shaped, it is not contemplated for the vibration isolators 30 used with the present invention egg-shaped supports 6 to be limited to a ring-shaped configuration in applications where vertical stacking is not needed or preferred. Thus, although not shown, alternative configurations for the vibration isolators 30 that can be used with the present invention may also include a convex upper surface, a flat top surface without a central bore 32, or any other configuration that is able to achieve the important goal of minimizing operational vibration or other vibration that might otherwise move a supported fluid-causing unit from its originally installed position relative to egg-shaped supports 6 and avoid unexpected weight transfer and possible pan collapse during unit operation. For its vibration-dampening use, it is contemplated for vibrations isolators 30 to be made from resilient material, such as but not limited to rubber. When vibration isolators 30 are made from (or adapted with) non-combustible materials (such as metal or ceramic, but not limited thereto), vibration isolators 30 can be used to meet non-combustible clearance requirements in furnace applications. One example of this is shown in FIG. 5 where an inverted cup 38 made from non-combustible material (such as but not limited to metal or ceramic) covers the top and side surfaces of a vibration isolator 30, with inverted cup 38 supported in its usable position via an upright post 36 having a cross piece 40 that engages the top surface of shoulder 52 and a bottom end (not separately numbered) that is secured within the lower end 54 of a vibration isolator 30. Upright post 36 (and preferably cross piece 40) would also be made from non-combustible materials (such as but not limited to metal or ceramic) and may have a slight downward taper to assist the providing of a secure and easy fit of the lower portion 54 of its associated vibration isolator 30 within an indentation 12 in the arcuate top surface 10 of an egg-shaped support 6. Although not shown, the configuration of cross piece 40 may be that of a horizontally-extending disk (with or without holes or other openings therethrough) having a diameter dimension similar to the top surface of the vibration isolator 30 intended for association with it, or cross piece 40 may be formed from one or more horizontally-extending braces that span bore 32 but do not extend much beyond the outer surface of shoulder 52 to prevent wobble of inverted cup 38 relative to the vibration isolator 30 beneath it. Thus, when the configuration in FIG. 5 is used, the top end (made from non-combustible material) of the upright post 36 is in contact with the bottom surface of a fluid-causing unit, with the rib 34 and much of the lower portion 54 of the vibration isolator 30 that surrounds the bottom end of upright post 36 being secured within the indentation 12 in the arcuate top surface 10 of one of the egg-shaped supports 6 in most preferred embodiment 2. When upright post 36 and inverted cup 38 are both be made from non-combustible materials, the non-combustible clearance needed in furnace applications is provided simply by their presence, while their close association with a vibration isolator 30 made from resilient material still provides needed vibration dampening for the supported fluid-causing unit to maintain the fluid-causing unit substantially in its originally installed position and avoid unexpected weight transfer that could lead to possible pan collapse during unit operation and positioning upon egg-shaped supports 6. Although FIGS. 1 and 6 show the top surface 10 of each egg-shaped support 6 having a circular indentation 10 and FIG. 3 shows vibration isolator 30 also having a circular cross-section, it is also contemplated (but not shown) for indentations 10 and vibration isolators 30 to have other arcuate configurations, including but not limited to an elliptical configuration, as long as the indentation 10 receiving a vibration isolator 30 is able to hold it securely in place to allow minimal opportunity for movement of a supported fluid-causing unit relative to perimeter wall 4 during routine use that could otherwise potentially lead to unexpected weight transfer and possible pan collapse, and potential fluid damage to surroundings.

What is claimed is:

1. A pan of enhanced material strength that is used for support of a fluid-causing unit in fluid collection applications and fluid overflow prevention applications, said pan comprising:

a perimeter wall depending upwardly from and defining an interior bottom surface; and a plurality of upwardly-tapering egg-shaped supports upwardly depending from said interior bottom surface in selected spaced-apart locations from one another and configured to allow for the even pulling of plastic during manufacture of said pan to strengthen said pan by substantially minimizing areas having less material thickness, said egg-shaped supports also positioned in spaced-apart locations from one another that allow balanced support of the heaviest fluid-causing unit intended for use therewith, said egg-shaped supports further positioned in spaced-apart locations one from the another on said interior bottom surface for even fluid distribution thereon that avoids pooling of the fluid in any one area of said interior bottom surface, and said egg-shaped supports also extending upwardly above said perimeter wall, whereby when a fluid-causing unit is placed collectively upon said egg-shaped supports, fluids from the unit are collected in said pan without causing overflow damage to its surroundings as a result of premature pan failure due to cracking of weak spots, or further as a result of buckling or sagging of said interior bottom surface due to pooling of collected fluid in localized areas.

2. The pan of claim 1 wherein said egg-shaped supports each have a top surface with at least one indentation therein, and further comprising a plurality of vibration isolators each made from resilient material and configured with a lower portion that is shaped for secure engagement with one of said top indentations, so that when a needed number of said vibration isolators are associated with a sufficient number of said indentations needed for safe, secure, and balanced support of a fluid-causing unit and the unit is lowered onto said vibration isolators collectively, said vibration isolators become positioned between the fluid-causing unit and said egg-shaped supports thereby reducing vibration from operation of the fluid-causing unit and other vibration that attempts to move between said egg-shaped supports and said fluid-causing unit to help maintain the fluid-causing unit substantially in its originally installed position relative to said egg-shaped supports during routine use, and thereby avoid unexpected weight transfer of the fluid-causing unit that could potentially lead to premature collapse of said pan, said vibration isolators also providing enhanced heat deflection around the fluid-causing unit.

3. The pan of claim 2 wherein said vibration isolators are positioned in multiple stacked array during use.

4. The pan of claim 2 wherein said vibration isolators are selected from a group consisting of vibration isolators made from high-friction materials, resilient materials, materials capable of reducing vibration, materials capable of reducing slippage of one object relative to another, materials capable of enhancing heat dissipation, resilient materials that also are non-combustible and meet non-combustible clearance requirements for furnace applications, vibration isolators made from resilient materials and adapted with non-combustible materials sufficient to meet non-combustible clearance requirements in furnace applications, vibration isolators made from resilient materials and used with an associated upright post and inverted cup made from non-combustible materials sufficient to meet non-combustible clearance requirements in furnace applications, and vibration isolators made from resilient materials and used with an associated upright post, at least one horizontally-extending cross-piece associated with said upright post, and an inverted cup all made from non-combustible materials sufficient to meet non-combustible clearance requirements in furnace applications.

5. The pan of claim 1 wherein said perimeter wall has at least one strength-enhancing and stress line reducing feature selected from a group consisting of gussets integrated with said perimeter wall, adjacent ones of said gussets having interior-projecting edges with depth dimensions differing from one another, angled corners, an upturned lip, at least one rib interconnecting adjacent ones of said gussets; at least one mounting shelve with a drain opening therethrough and a configuration adapted for quick-mounting of a drain line connection, and at least one arcuate ribbed area configured for protecting a float switch in fixed association with a drain line connection from side impact directed toward said perimeter wall.

6. The pan of claim 1 wherein said pan is made from materials selected from a group consisting of polycarbonate, polycarbonate alloys, polycarbonate blends, polycarbonate alloys and blends using ABS, polycarbonate alloys and blends using PBT, polycarbonate alloys and blends using PET, polycarbonate alloys and blends using PP, materials impervious to corrosion, impact resistant materials, UV-resistant materials, heat resistant materials, materials substantially unaffected when subjected to temperature extremes.

7. The pan of claim 1 wherein at least one of said egg-shaped supports further comprises an elliptical base.

8. The pan of claim 7 further comprising an arcuate annular ridge around said elliptical base of at least one of said egg-shaped supports.

9. The pan of claim 7 further comprising an upwardly-tapering protrusion associated with at least one of said egg-shaped supports that in combination with said elliptical base forms a substantially triangular shape that strengthens said interior bottom surface by broadening the weight distribution of the supported fluid-causing unit across more of said interior bottom surface.

10. The pan of claim 9 further comprising an arcuate annular ridge around said substantially triangular shape formed by said elliptical base and said protrusion.

11. The pan of claim 9 wherein at least one of said egg-shaped supports further comprises an arcuate top surface.

12. The pan of claim 11 wherein said at least one protrusion has a convexly-shaped top edge that extends from said elliptical base toward said arcuate top surface.

13. The pan of claim 8 further comprising at least two of said annular ridges and at least one stress-transmitting rib extending between said at least two annular ridges.

14. The pan of claim 13 wherein said at least one stress-transmitting rib and said at least two annular ridges all have substantially the same height dimension.

15. The pan of claim 13 wherein transitions between each said annular ridge and said stress-transmitting rib are softened to reduce stress points.

16. The pan of claim 1 wherein said pan is made as a single unit from molded construction.

17. The pan of claim 1 wherein said egg-shaped supports each have a configuration adapted to allow compact nesting of said pans in stacked array.

18. The pan of claim 1 wherein an even number of said egg-shaped supports are provided, and further wherein said egg-shaped supports upwardly-depend from said interior bottom surface in two substantially parallel, spaced-apart, and longitudinally-extending rows with half of said egg-shaped supports in each said row, and further wherein said two rows are in non-centered orientation relative to said perimeter wall.

19. A method of supporting a fluid-causing and collecting fluid from the unit to prevent fluid overflow damage to surroundings through use of the pan in claim 2, said method comprising the steps of:

providing a fluid-causing unit and the pan of claim 2;

placing a different one of said vibration isolators in said top indentation of a sufficient number of said egg-shaped supports for safe, secure, and balanced support of said fluid-causing unit; and placing said fluid-causing unit atop said vibration isolators so that all fluid from said fluid-causing unit will be directed toward said interior bottom surface for accumulation within said pan instead of making contact with surroundings around said fluid-causing unit and said pan.

20. The method of claim 19 wherein said perimeter wall further comprises a mounting shelf and further comprising the step of providing a float switch and drain line connection assembly wherein said float switch is in fixed association with said drain line connection and said drain line connection is configured for quick mounting to said mounting shelf, the step of securing said drain line connection to said mounting shelf wherein said float switch is instantly placed into a leveled position relative to said pan, the step of electrically connecting said float switch to said fluid-causing unit, and the step of preparing said float switch to establish a deployment threshold fluid level considered safe to prevent fluid overflow and fluid damage to surroundings of said pan and said fluid-causing unit so that said float switch will send a shut-off signal to said fluid-causing unit when fluid collected in said pan exceeds said pre-established threshold fluid level, whereby when said pan is leveled during its installation, prompt, reliable, and repeat vertical deployment of said float switch is achieved without malfunction to shut off said fluid-causing unit supported upon said vibration isolators whenever fluid collected in said pan rises above said pre-established threshold fluid level considered safe.

21. A drain pan for supporting a fluid-causing unit in fluid collection applications and fluid overflow prevention applications, said drain pan comprising:

a substantially rectangular perimeter wall depending upwardly from and defining an interior bottom surface, said perimeter wall having at least one strength-enhancing feature selected from a group consisting of an upturned lip, angled corners, spaced-apart gussets with interior-projecting front edges in staggered array, and gussets with horizontally-extending perimeter ribs between them;

a plurality of upwardly-tapering egg-shaped supports upwardly depending from said interior bottom surface in selected spaced-apart locations from one another that allow balanced support of the heaviest fluid-causing unit intended for use therewith, each said egg-shaped support further positioned in spaced-apart locations one from the another on said interior bottom surface for even fluid distribution around said egg-shaped supports that avoids pooling of the fluid in any one area of said interior bottom surface, each said egg-shaped support also extending upwardly above said perimeter wall, and each said egg-shaped support further having a top indentation, an elliptical base, and an arcuate top surface;

an upwardly-tapering protrusion associated with each said egg-shaped support that in combination with said elliptical base of said egg-shaped support forms a substantially triangular shape, said protrusions each having a convexly-shaped top edge that extends from said elliptical base toward said arcuate top surface of the associated one of said egg-shaped supports;

an arcuate annular ridge around each of said substantially triangular shapes;

at least one stress-transmitting rib extending between at least two of said annular ridges, with said at least one stress-transmitting rib and said at least two annular ridges connected therewith all have substantially the same height dimension, and also with connection between said at least one stress-transmitting rib and one of said annular ridges having a softened transition configured to reduce stress points; and a plurality of vibration isolators each made from resilient material and configured with a lower portion that is shaped for secure engagement with one of said top indentations, so that when said vibration isolators are associated with a sufficient number of to support a fluid-causing unit and the fluid-causing unit is lowered onto said vibration isolators collectively, said vibration isolators become positioned between the fluid-causing unit and said egg-shaped supports thereby reducing vibration from operation of the fluid-causing unit and other vibration that attempts to move between said egg-shaped supports and said fluid-causing unit to help maintain the fluid-causing unit substantially in its originally installed position relative to said egg-shaped supports during routine use, and thereby avoid unexpected weight transfer of the fluid-causing unit that could potentially lead to premature collapse of said pan, and further fluids from the unit are collected in said pan without causing overflow damage to its surroundings as a result of premature pan failure due to cracking as a result of weak spots and buckling or sagging of said interior bottom surface due to pooling of collected fluid in localized areas, said vibration isolators also providing enhanced heat deflection around the fluid-causing unit.

* * * * *